United States Patent [19]

Teetz

[11] 4,052,945

[45] Oct. 11, 1977

[54] PATTERN CONTROL MECHANISM FOR EMBROIDERING MACHINE

[75] Inventor: Wolfgang Teetz, Kerken, Germany

[73] Assignee: Maschinenfabrik Carl Zangs Aktiengesellschaft, Krefeld, Germany

[21] Appl. No.: 724,104

[22] Filed: Sept. 16, 1976

[30] Foreign Application Priority Data

Sept. 17, 1975 Germany ..... 2541418

[51] Int. Cl.[2] ..... D05C 5/00

[52] U.S. Cl. ..... 112/86; 112/79 A; 139/59

[58] Field of Search ..... 112/84, 85, 86, 83, 112/79 R, 79 A; 139/59, 62, 63, 64, 65

[56] References Cited

U.S. PATENT DOCUMENTS

| | | | |
|---|---|---|---|
| 435,875 | 9/1890 | Wilcox et al. | 112/84 |
| 611,011 | 9/1898 | Hill | 112/86 |
| 2,050,780 | 8/1936 | Bohmann et al. | 112/86 |
| 3,177,834 | 4/1965 | Urscheler | 112/83 |
| 3,669,154 | 6/1972 | Horak | 139/63 |

FOREIGN PATENT DOCUMENTS

| | | | |
|---|---|---|---|
| 429,325 | 5/1926 | Germany | 112/86 |
| 1,110,805 | 7/1961 | Germany | 112/84 |

*Primary Examiner*—H. Hampton Hunter
*Attorney, Agent, or Firm*—Joseph A. Geiger

[57] ABSTRACT

A pattern control mechanism for embroidering machines of the type which use punched tape and a gear-type analog computer with input cam slides for the generation of pattern movements in a large number of different magnitudes, the improvement relating to the cam slide driving mechanism, where pivotable horizontal slide pushers which are attached to the cam slides are selected vertically by transversely moving selector bars whose position is determined by feeler needles of the punched tape sensing device, and where the raised non-selected slide pushers remain back, while the lowered selected ones are engaged by a reciprocating pusher drive bar. The selector bars, which execute a vertical approach motion, have selector teeth which prevent the simultaneous drive engagement of both cam slides.

14 Claims, 10 Drawing Figures

PATTERN CONTROL MECHANISM FOR EMBROIDERING MACHINE

BACKGROUND OF THE INVENTION

1. Field of the Invention

The present invention relates to variable-advance motion generating mechanisms, and more particularly to punched card controlled pattern generating mechanism, such as are used in conjunction with embroidering machines, for example.

2. Description of the Prior Art

Automatic embroidering machines may be of the single-needle type or of the multi-needle type. A machine of the latter designation has a number of embroidering stations, each with an embroidering needle executing a continuous stitching motion. The embroidery pattern is created by moving the fabric under the needle. For this to happen, the embroidery frame must execute a lateral movement, in order to create the sewing of the embroidery stitches, and a fabric advancing movement, in order to develop the embroidery design.

The emrbroidery frame movements which are required for the production of even simple embroidery designs are so complex and require so many different movement increments that the automatic generation of these movements virtually always requires the use of an information carrier from which the pattern instructions are read and automatically converted into corresponding embroidery frame movements. Probably the oldest type of information carrier, and still in many cases the best suited one, are punched cards or a punched tape, frequently referred to as jacquard cards or jacquard tapes.

One such punched card embroidery pattern control mechanism is disclosed in the German Pat. No. 429,395. The mechanism suggested in this prior art disclosure is intended to produce a sequence of embroidery frame movements whose magnitude is randomly adjustable to any integer between 1 and 40. To accomplish this, the prior art mechanism features a punched tape reading mechanism which translates the absence of a hole in the tape into a control motion of one of a pair of cam slides which interacts with a gear-type analog computer to produce either a positive, or a negative, or zero movement input. Subsequent pairs of cam slides produce movement inputs of a different magnitudes which are combined by the differential gear type computer, so as to selectively produce output magnitudes which may vary between 1 unit and 40 units. A similar device may be used to produce the second embroidery frame motion component.

The described prior art mechanism has enjoyed considerable commercial success. One of its shortcomings, however, relates to the fact that it requires a comparatively heavy punched tape, since the latter has to be strong enough to withstand the forces which are necessary to move the cam slides and, by way of the latter, the levers and gears of the differential gear computer mechanism. Another shortcoming of this mechanism is its comparatively slow rate of operation, due to the limitations on its reading speed which, if increased, correspondingly increases the risk of damage to the punched tape, due to the mass inertia of the parts which are being directly driven by the punched tape.

SUMMARY OF THE INVENTION

It is a primary objective of the present invention to suggest an improved pattern control mechanism, paticularly one which is suited for use as an improvement of the control mechanism described in German Pat. No. 429,395, where the aforementioned shortcomings of operational slowness and risk of damage to the punched tape are reduced or eliminated.

The present invention proposes to attain this objective by suggesting an improved pattern control mechanism of the type mentioned, where the forces for moving the cam slides and for rotating the analog computer gears are not generated by the punched tape itself, but by an intermediate drive mechanism and cooperating selector members which transmit the information which has been read from the punched tape by feeler needles, to drive members or pushers which are connected to the cam slides.

In a preferred embodiment of the invention, this intermediate drive mechanism uses a matrix-type arrangement of the punched tape positioned selector bars and of the power driven drive members or pushers of the cam slides. The latter are preferably oriented horizontally and interact with the transverse selector bars through gravity, thereby producing a selection in the sense of raised or lowered pushers which may or may not be engageable by a horizontally moving pusher drive bar. The positioning of the pushers is controlled by appropriate tooth formations on the selectors bars.

By way of a further improvement, the present invention also suggests that the connection between the punched tape reading feeler needles and the transverse selector bars be not a rigid one, although longitudinally non-yielding, and that the selector bars be lowered away from the cam slide pushers, while being repositioned by the feeler needles for the next movement cycle.

To accomplish this, the preferred embodiment of the invention suggests a selector bar guide frame which is pivotable around a horizontal axis, or which is otherwise vertically movable. Apart from thereby simplifying the tooth configuration of the selector bars, this vertical movement of the selector bars has the advantage of allowing for a timing overlap between the punched tape reading cycle and the cam slide driving cycle. It signifies that the reading cycle can be smoothed out and accelerated to where the reading speed is limited only by the limitations of the punched tape indexing mechanism and the movement inertia of the feeler needles and connected selector bars. The latter can be made extremely light, so that both the inertia forces and the return spring loads are kept small.

On the other hand, the proposed improvements make it possible to strengthen the cam slides and the associated differential gear computer mechanism, so that greatly increased embroidery frame movement forces can be generated and tolerated by the device. These adjustment forces are no longer limited by the strength of the punched tape, but are isolated therefrom, being generated by the proposed novel cam slide drive mechanism. It follows from this higher tolerance for inertia forces and from the capability of generating higher adjustment forces that the operating speed of the machine can be increased accordingly.

In the preferred embodiment of the invention is further suggested that the pusher members of the cam slides be attached to the latter with a pivot connection, and that each pair of cam slides be coordinated with a pair of selector bars which are controlled by two hole tracks on the punched tape. The selector bars are preferably flat profiles which are guided on edge and which carry simple upwardly protruding square teeth for the vertical drive selection of the slide pushers.

Lastly, the invention also suggests a safety feature against the simultaneous drive selection of both cam slides of a slide pair, in order to prevent the mechanical blockage and destruction of the mechanism which would follow as a result of such a selection. For this purpose, the invention further suggests that the pair of selector bars which controls a particular pair of cam slides have such a tooth pattern that each selector bar, while deflecting its associated slide pusher upwardly, i.e. out of driving range, in the absence of a hole in the punched tape, deflects the other pusher bar upwardly in the presence of a hole in the punched tape.

The result is that a slide pusher is only then being lowered for driving engagement, when it finds a tooth gap in both selector bars, and that this is only then possible, when the one or the other of the two selector bsrs executes a selecting displacement. No driving engagement is possible when neither or both selector bars move.

The suggested cam slide drive mechanism features a transversely oriented horizontally reciprocating drive bar with a generally angular profile, having a forwardly extending leg portion serving as a supporting ledge and an upwardly extending leg portion serving as a drive face. The drive stroke of the drive bar 5 is so arranged in relation to the rear extremities of the slide pushers that the drive face moves a short distance behind the pusher extremities, while the horizontal ledge of the drive bar remains underneath the latter at the end of the drive bar stroke. This means that, since the pusher selection takes place during the return movement of the drive bar, the selected pushers will ride on the upper edge of the drive bar, until they drop from there to the horizontal ledge of the drive bar at the time of stroke reversal, while the non-selected pushers remain raised and outside the reach of the drive bar until the latter moves forwardly under the extremities of the raised pushers which remain behind. At that moment, the entire selector assembly, carried by a pivotable frame, can be lowered for the next tape reading cycle in which the selector bars are prepositioned for the subsequent drive stroke of the pusher drive bar.

The removal from the punched tape reading mechanism of the requirement to drive the cam slides not only makes it possible to utilize a more compact reading mechanism with smaller, more closely spaced feeler needles, it also makes it possible to arrange a greater number of information tracks on the punched tape, including tracks which are not used for the generation of the embroidery frame movements, but which may be used for such other control information as automatic changeover commands for yarn change or color change in a multi-color machine and for the execution of a skip stitch through immobilization of the embroidering needles, when the machine moves from one embroidery pattern to the next. The feeler needles which read these auxiliary information tracks are preferably operated by the same feeler drive bar which operates the feeler needles for the selector bars. However, their commands may be transmitted electrically, using microswitches and relays, for example.

BRIEF DESCRIPTION OF THE DRAWINGS

Further special features and advantages of the invention will become apparent from the description following below, when taken together with the accompanying drawings which illustrate, by way of example, a preferred embodiment of the invention, represented in the various figures as follows.

DESCRIPTION OF THE PREFERRED EMBODIMENT

Figure 1:
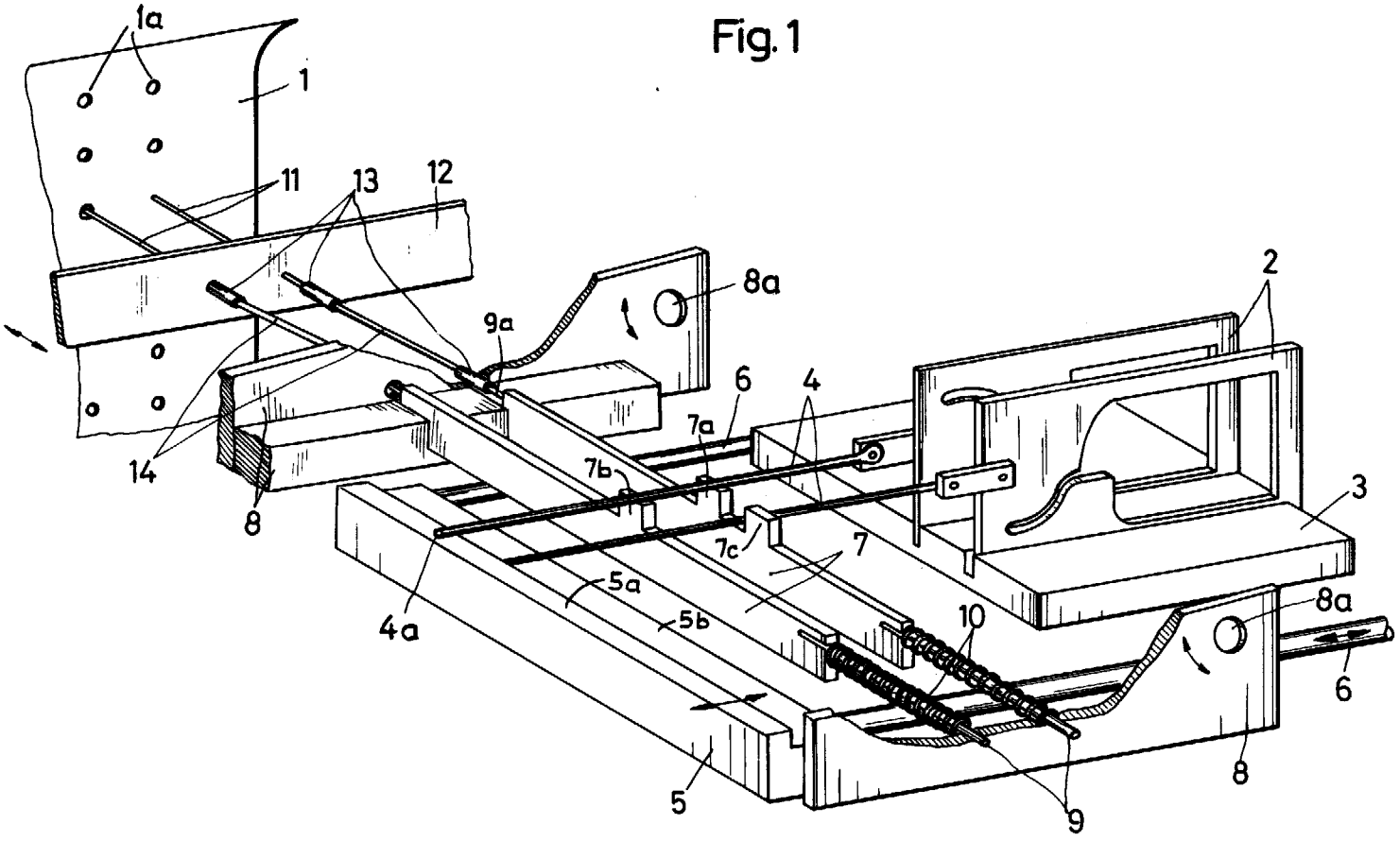
FIG. 1 shows a representative portion of the pattern control mechanism of the invention in a somewhat schematic perspective representation.
Figure 2:
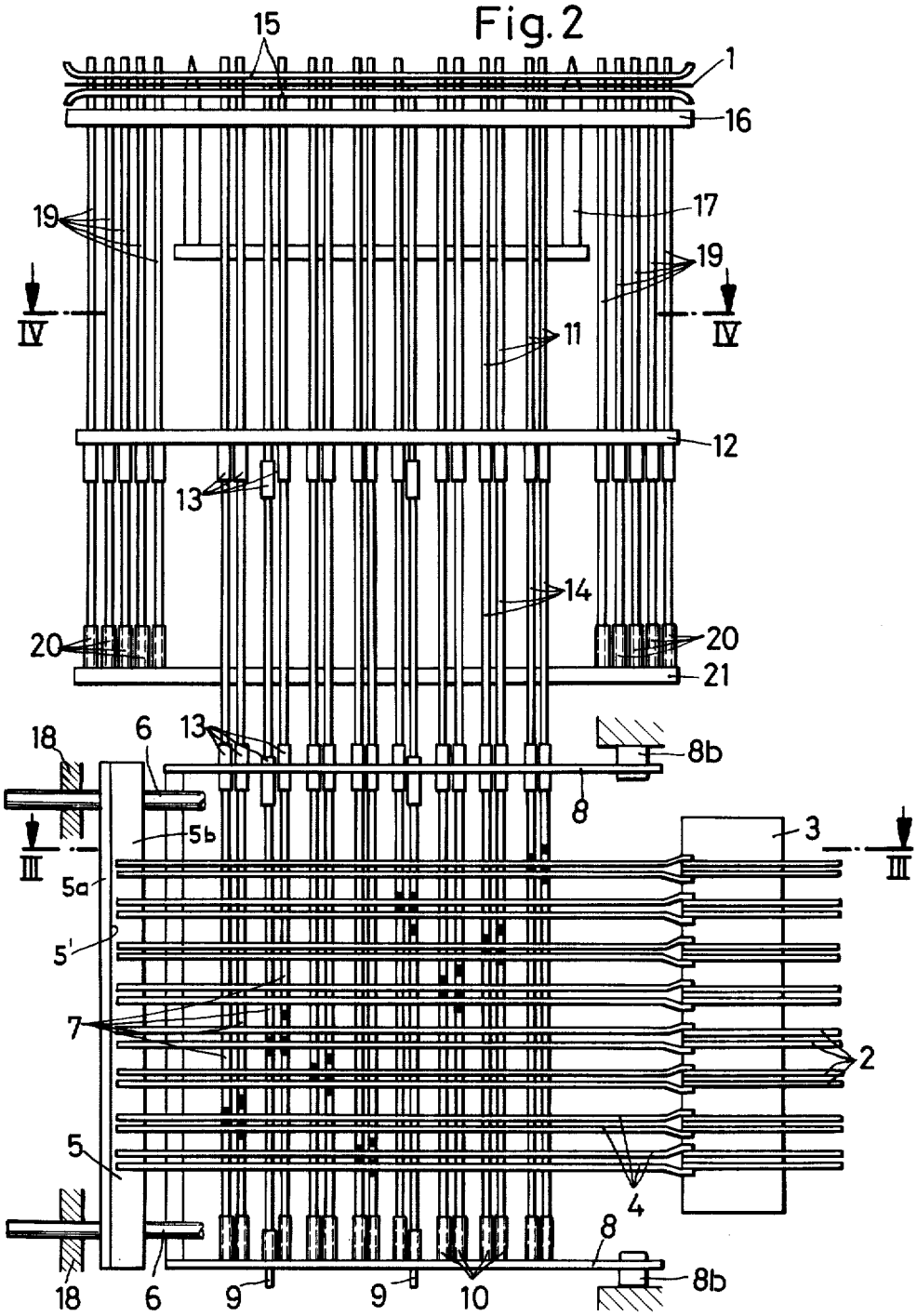
FIG. 2 shows the pattern control mechanism of the invention in a plan view.
Figure 4:
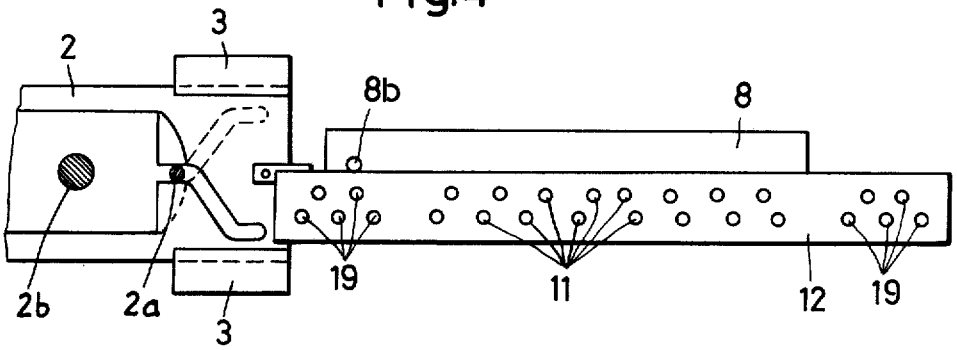
FIG. 4 is another transverse cross section of the device of FIG. 2, taken along line IV—IV thereof.

The present invention is to be understood as an improvement which is most advantageously employed in conjunction with the known embroidery pattern control mechanism described in German Patent No. 429,395, or with a similar mechanism which is driven by a plurality of cooperating pairs of cam slides, in an arrangement which is similar to the arrangement of the cam slides 2 which are shown in FIGS. 1 and 2 of the drawing. In the known device, each pair of cam slides is engaged by a drive pin **2*a* of an input member (not shown) of a gear-type analog computer whose center shaft is shown at 2*b* (FIG. 4). Each pair of cam slides produces one of three input values: zero input, when both cam slides remain in their retracted position; a positive unitary input, when the one of the two cam slides advances against the pin 2*a*; and a negative input of the same size, when the other of the two cam slides advances against the pin 2*a*. A simultaneous advance of both cam slides 2** is not possible, and the device to be described further below includes a safety feature for the prevention of a selection that would produce such a simultaneous motion input.

Referring to FIG. 1 of the drawing, there is shown, in a somewhat simplified schematic representation, a device which, on the basis of punched hole information contained on a punched tape 1, selects and drives the cam slides 2, thereby converting the punched tape information into a forcible displacement information on the pair of cam slides 2, for input of this displacement information into an analog computer of an embroidery pattern control mechanism of the type mentioned further above. For the sake of clairty of the drawing, FIG. 1 shows only one pair of cam slides 2 and a cooperating pair of hole tracks **1*a* on the punched tape 1 which are being read by two feeler needles 11. A complete set of cam slides 2 and a corresponding set of feeler needles 11 are shown in FIG. 2**.

The upright cam slides 2 are guided for longitudinal motion by means of suitable guide racks 3 which engage the upper and lower edge portions of the cam slides (see FIG. 3), only the lower guide rack 3 being shown in FIGS. 1 and 2. To each cam slide 2 is pivotably attached a rod or slide pusher 4, extending horizontally rearwardly from the cam slide 2. Each slide pusher 4, by its weight, rests on either a transversely extending selector bar 7 arranged underneath it, or on a likewise transversely extending pusher drive bar 5. The latter executes a reciprocating drive motion in a horizontal plane, as indicated by the double arrow in FIG. 1, the stroke of the drive bar 5 being equal to the desired longitudinal displacement of the cam slides 2.

The drive bar 5 is moved and carried by means of two horizontally guided drive rods 6 which receive their drive from a suitable reciprocating motor means which is not shown in the drawing. As is shown in FIG. 2, the drive bar 5 is arranged to selectively cooperate with any or all of the slide pushers 4. The profile of the drive bar 5 resembles that of an angle. The angle, as can best be seen in FIG. 3, has a forwardly extending leg portion or supporting ledge 5*b* and an upwardly extending leg portion 5*a*, presenting a forwardly oriented driving face to the slide pushers 4.

The length of the slide pushers 4 is such that their rear extremities 4*a* are positioned just ahead of the driving face of the drive bar 5, when the latter reaches the rear end of its stroke. Consequently, depending on the level at which the pushers 4 are held by the selector bars 7, their rear extremities 4*a* will either be positioned above the upper edge of the driving face of the drive bar 5, or the pushers 4 will come to rest on the supporting ledge 5*b*, in front of the driving face of the drive bar 5. Those pushers which have thus been lowered into driving engagement with the drive bar 5 will then be moved forwardly in the subsequent drive bar stroke. A suitable pusher return frame (not shown), which is operatively attached to the drive rods 6, returns the displaced cam slides 2 to their retracted position, when the drive bar executes its return stroke.

As is illustrated in FIG. 2, every pair of cam slides 2 and attached slide pushers 4 has associated with it a transversely extending pair of selector bars 7, whereby the slide pushers and the selector bars form a regular matrix pattern. The selector bars 7 are guided on both ends in parallel brackets of a horizontal selector bar guide frame 8. The latter is pivotable between an upper position in which the selector bars 7 interact with the slide pushers 4 to effect the desired drive selection, and a lower position in which the slide pushers 4 are out of reach of the selector bars 7.

Each selector bar 7 has a guide pin attached to both extremities, the longer guide pin 9 on its rear extremity carrying a compression spring or feeler spring 10. To the forward guide pin 9*a* of each selector bar 7 is coupled a selector link 14 which, in turn, is connected to a feeler needle 11. Suitable connecting sleeves 13 provide the connections between the forward guide pins 9*a* of the selector bars 7 and the selector links 14, as well as the connections between the selector links 14 and the feeler needles 11. These connecting sleeves are so designed that the connected parts can undergo a small angular deflection in relation to each other, in order to accomodate the vertical displacements of the selector bars 7. Accordingly, while the selector bars 7 and the feeler needles 11 are both guided for horizontal sliding displacements, the simultaneous vertical movements of the selector bars 7 are accomodated by a tilting movement of the intermediate selector links 14, made possible by their flexible coupling sleeves 13.

The selecting movement of the feeler needles 11 and of the connected selector bars 7 is produced by a reciprocating feeler drive bar 12 which, by engaging the connecting sleeves 13 between the needles 11 and the links 14, retracts the feeler needles 11, while a tape indexer 17 of conventional design advances the punched tape 1 to the next reading line. As the feeler drive bar 12 returns to its forward position, each feeler spring 10 causes its associated selector bar 7 and feeler needle 11 to follow the drive bar 12, advancing against the punched tape 1, where the feeler needle 11 passes through a hole, if one is present in the punched tape 1, or is stopped by the punched tape 1, if no hole is present. The effect of this reading selection will be described further below, in connection with FIGS. 5 through 10.

The plan view of FIG. 2 further shows the tape guides 15 for the punched tape 1 and a feeler needle guide 16, arranged just in front of one of the punched tape guides 15. The tape indexer 17 is shown in a schematic sense only, and it should be understood that any coventional tape indexing mechanism, suitably synchronized with the movement of the feeler drive bar 12, can be used for this purpose. In FIG. 2 is further shown how the selector guide frame 8 is pivotably attached to the machine frame, by means of pivot pins 8*b*, and how the drive rods 6 for the pusher drive bar 5 are guided in guide bores of a machine frame portion 18.

Figure 3:
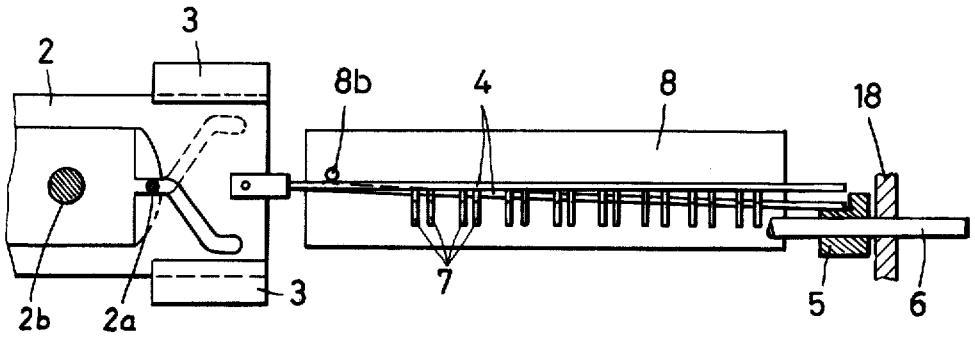
FIG. 3 is a transverse cross section through the device of FIG. 2, taken along line III—III thereof.

In FIG. 3 of the drawing, the selector guide frame 8 is shown in its upper position in which the selector bars 7 interact with the slide pushers 4 to produce the desired drive selection in which selected pusher bars are engaged by the drive bar 5, while others remain above the reach of the drive bar. The transverse selective positioning of the selector bars 7 thus takes place, when the selector guide frame is in its lower position, and while the previously selected slide pushers 4 are being driven by the drive bar 5. This means that, while the driven slide pushers 4 rest on the supporting ledge 5*b* and are engaged by the driving face of the drive bar 5, the nondriven slide pushers 4 rest on the upwardly extending leg portion 5*a* of the drive bar 5, as the latter executes its drive stroke.

The vertical pivoting movement of the selector guide frame is preferably so timed in relation to the reciprocating movement of the drive bar 5 that the selector bars 7 are lowered out of reach of the slide pushers 4, as soon as the drive bar 5 has moved underneath the rear extremities 4*a* of the non-selected, raised slide pushers 4, and that the meanwhile repositioned selector bars 7 are raised again during the return stroke of the drive bar 5, either when the latter has reached its rear reversal point, or shortly therebefore. Those slide pushers 4 which had previously been selected and driven, if they are now to remain out of action, will thereby be lifted from the supporting ledge 5*b* of the drive bar 5 and raised above the level of the driving face of the latter. Conversely, those slide pushers 4 which had previously been out of action, through non-selection, and which had therefore rested on the upper edge of the drive bar 5, if they are now to be driven, will drop onto the supporting ledge 5*b*, in front of the driving face of the drive bar 5, at the moment at which the latter reaches its fully retracted position.

Since the positioning of the selector bars 7 takes place while the latter are retracted below the level of the slide pushers 4, it suffices for the selector bars 7 to be provided with simple upwardly facing square selector teeth which, when positioned underneath a slide pusher 4, raise the latter above the reach of the drive rear 5. The shape of these teeth is visible in FIG. 1, and their function and interaction with the slide pushers 4 will not be explained in detail, in reference to FIGS. 5 through 10.

Figure 5:
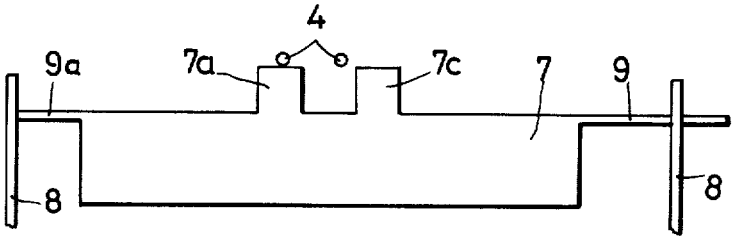
FIGS. 5 and 6 separately show the two selector bars of a selector bar pair in an elevational side view.
Figure 6:
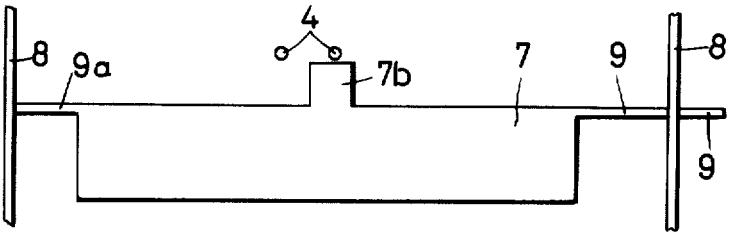

In FIGS. 5 and 6 are shown two selector bars 7 which make up a cooperating selector bar pair. Both selector bars 7 are guided for longitudinal motion in the selector guide frame 8, engaging the latter with their front and rear guide pins 9*a* and 9, respectively. The selector bars 7 are shown in a position relative to the two slide pushers 4 in which the slide pusher selection is just taking place, as the selector bars 7 move upwardly. Thus, while the slide pusher 4 on the left is engaged by the selector tooth 7*a* of the selector bar 7 of FIG. 5, the slide pusher 4 on the right is engaged by the selector tooth 7*b* of the selector bar 7 of FIG. 6. This signifies that both pushers 4 are raised above the driving reach of the drive bar 5.

Figure 7:
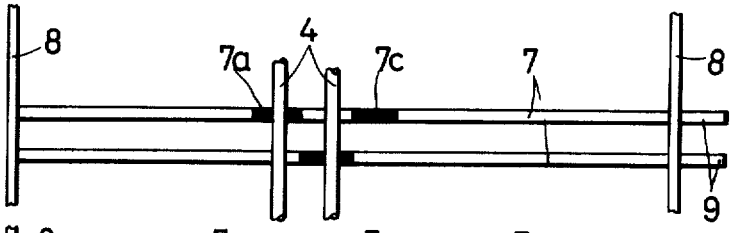
FIGS. 7 through 10 show the selector bar pair of FIGS. 5 and 6 in a plan view, in four different selection configurations.

It will readily be understood that the two feeler needles 11, reading the two hole tracks 1*a* of the punched tape 1, can assume any one of four different readout positions, depending on the presence or absence of holes in the two hole tracks. These four possibilities are illustrated in FIGS. 7 through 10:

The selector bar positions of FIG. 7 are those which result from the absence of a hole in either of the two hole tracks l*a* on the punched tape 1. The selector bar positions in this figure are the same as those shown in FIGS. 5 and 6. Accordingly, both slide pushers 4 will be raised and will therefore not be driven.

Figure 8:
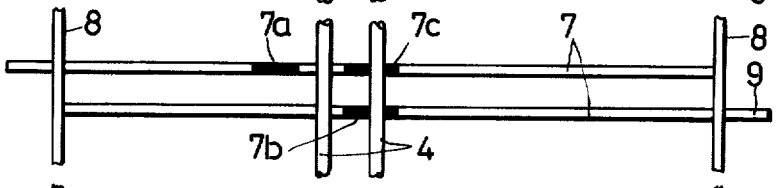

The selector bar positions in FIG. 8 reflect the absence of a hole in the left-hand hole track and the presence of a hole in the right-hand hole track on the punched tape 1. This means that, while the left-hand selector bar 7 is stopped by the punched tape 1, the right-hand selector bar 7 has been free to advance towards the punched tape, thereby aligning the tooth gap between its selector teeth 7*a* and 7*b* with the left-hand slide pusher 4. As a result, the left-hand slide pusher will not be raised and will either remain supported on the ledge 5*b* of the drive bar 5, if it had already been driven previously, or it will drop from the upper edge of the drive bar 5 onto the supporting ledge 5*b*, as soon as the drive bar 5 reaches the rearward end of its stroke.

Figure 9:
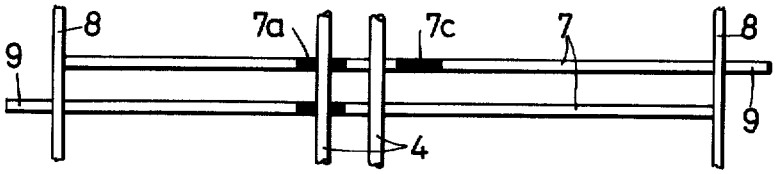

In FIG. 9, the situation is the reverse of that shown in FIG. 8, a hole being present in the left-hand hole track, while none is present in the right-hand hole track. In this case, the right-hand selector bar 7 stays back, while the lefthand selector bar has advanced toward the punched tape 1, thereby aligning its selector tooth 7*b* with the selector tooth 7*a* on the other selector bar 7. The result is that the right-hand slide pusher 4 will be selected for driving engagement, while the left-hand slide pusher 4 is raised out of driving range. This configuration is the same as the one which is shown in the illustration of FIG. 1.

Figure 10:
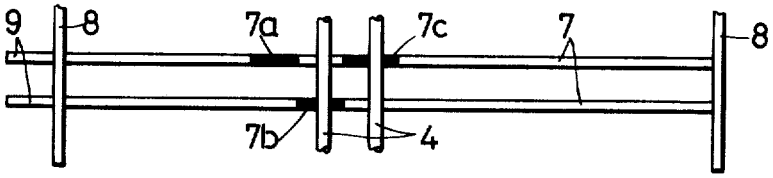

The fourth possibility of selector bar positioning is indicated in FIG. 10, where both feeler needles 11 have encountered holes in their hole tracks 1*a* on the punched tape 1, and both selector bars 7 have accordingly been shifted forwardly by their feeler springs 10. The result, however, is identical with that achieved with the configuration of FIG. 7, viz. that one slide pusher 4 is raised by one selector bar 7, while the other slide pusher 4 is raised by the other selector bar 7.

The overall operation of the selector bars 7 is therefore such that it is impossible for a simultaneous drive selection of both slide pushers 4 to occur, whether both hole tracks 1*a* on the punched tape 1 have holes, or whether both are without holes. This safety feature is extremely important, because the simultaneous drive selection of both slide pushers 4 of a cam slide pair would cause the cam slides to become blocked against each other, leading to the buckling of the slide pushers involved, or to some other permanent distruction. Underlying this safety feature is the fact that the selection interaction between the selector bars 7 and the slide pushers 4 is chosen in such a way that each selector bar separately can prevent a slide pusher 4 from being selected, while it takes both selector bars 7 to select a slide pusher 4 for driving engagement, and further, that drive selection takes place only then, when one, and only one, of the two selector bars 7 is moved.

These requirements are fullfilled with a selector tooth arrangement in which each selector bar 7 blocks one slide pusher 4 in one of its two positions, while blocking the other slide pusher 4 in the other position. With the selector teeth so staggered that identical positions of the two selector bars 7 block both slide pushers 4, it is consequently only necessary to have a spaced pair of selector teeth 7*a* and 7*c* on one of the two selector bars (FIG. 5) and a single selector tooth 7*b* on the other selector bar (FIG. 6).

It should be understood that the selection interaction between the selector bars 7 and the slide pushers 4 of the proposed device may be either such that the presence of a hole in the punched tape 1 produces a drive engagement against the drive bar 5 or, conversely, that the absence of such a hole produces the desired drive engagement. It should further be understood that the selector guide frame 8, while being described as a vertically pivotable frame, could also be arranged to execute a straight-line vertical movement. Lastly, it is also possible to maintain the selector guide frame in a fixed position, while a vertical motion component is added to the movement of the drive bar, either by vertically moving its guides, or by giving it a reciprocating motion whose path includes a vertical motion component in the rear portion of the drive bar stroke.

Among the advantages which derive from the device of the present invention is the fact that the matrix arrangement of the slide pushers 4 and selector bars 7 eliminates the necessity for identical lateral distances between the hole tracks 1*a* on the punched tape 1 and the cam slides 2 of the pattern control mechanism. This not only makes it possible to laterally separate the cam slides 2 further than in the past, if needed; more importantly, it makes it possible to arrange the tracks on the punched tape at a much closer spacing. The simultaneous elimination of the need for the punched tape and the feeler needles to sustain cam slide driving forces further makes it possible to greatly reduce the dimensions and weight of the feeler needles and of the selector bars, for a very compact and light-weight overall structure of the device. These advantages, in turn, open up new possibilities in terms of higher operational speeds of the control device, favored by the fact that the selector bar positioning movement and the cam slide driving movement are performed in an overlapping timing relationship.

Furthermore, it is now readily possible to store more information on the punched tape, by providing additional information tracks which are being read by special needles, such as the auxiliary feeler needles 19 which are shown in FIG. 2, for the automatic generation of various other control signals which may be transmitted to the appropriate machine components in the form of electrical control pulses, for example. FIG. 2 shows auxiliary feeler needles 19 arranged on both sides of the cam slide controlling feeler needles 11, the auxiliary needles being likewise driven by the needle drive bar 12 and having auxiliary feeler springs 20 supported by a stationary supporting bracket 21. The movement of the auxiliary feeler needles 19 may be used to actuate microswitches, for example, or it may be transmitted mechanically, with or without power assist of the type provided by the pusher drive bar 5.

It should be understood, of course, that the foregoing disclosure described only a preferred embodiment of the invention and that is is intended to cover all changes and modifications of this example of the invention which fall within the scope of the appended claims.

I claim the following:

1. A mechanism for selectively driving pairs of cam slides of a pattern generating apparatus of the type which is used in automatic embroidering machines, for example, where cyclical movements of any of a large number of different magnitudes are generated by a gear-type analog computer whose input is mechanically derived from an advancing stroke, or from the absence of an advancing stroke, of a row of cooperating longitudinally guided cam slide pairs, as each cam slide pair produces a positive, or a negative, or zero unitary motion input, in accordance with pattern information which is fed to the device by a punched tape, the cam slide driving mechanism comprising in combination:

an elongated slide mover pivotably attached to one end of each cam slide and extending in general alignment with the direction of cam slide movement, each slide mover being pivotable over a small angle, between a selected position for driving engagement and a non-selected position in which it is to remain non-driven; the slide movers of a pair of cam slides forming a slide mover pair;

a plurality of elongated selector bars, equal in number to the number of slide movers and extending transversely to the latter in a plane which is substantially parallel to the general plane defined by the slide movers; pairs of selector bars being operatively associated with corresponding pairs of slide movers;

means for guiding the selector bars for longitudinal movements between an advanced selector bar position and a retraceted selector bar position;

selecting means carried by the selector bars for selection interaction with the slide movers, so as to determine the position of the latter, each of a pair of selector bars interacting with each one of an associated pair of slide movers, so that, when one of the two selector bars is in its advanced position and the other is in its retracted position, one of the two associated slide movers will be selected and the other will not be selected, while in all other selector bar positions neither slide mover will be selected, thereby precluding the simultaneous selection of both slide movers of a slide mover pair;

a slide mover drive bar extending transversely to the slide movers, including means for guiding and driving said drive bars in a synchronized reciprocating motion along a path of which at least a major motion component corresponds to the direction of cam slide movement, and of which the reversal point from a return stroke to a drive stroke is so related to the slide mover positions that the drive bar, in its drive stroke, engages and advances those slide movers which are in said selected position, while missing those slide movers which are in the non-selected position;

a punched tape, including a likewise synchronized, intermittently operating punched tape indexing drive, the punched tape having a hole track for each selector bar; and punched tape sensing means, including a feeler needle connected to each selector bar and biased towards the punched tape, in alignment with a hole track thereof, so as to move the selector bar to its advanced position in the presence of a hole in said hole track, while holding it in its retracted position in the absence of a hole in said track; said punched tape sensing means including a feeler needle drive bar executing a likewise synchronized reciprocating motion in which it withdraws all the needled from the punched tape, while the latter is advanced by its indexing drive.

2. A cam slide driving mechanism as defined in claim 1, wherein the selecting means of the selector bars are tooth-like protrusions on the latter which are oriented towards the slide movers and are so shaped that, when a protrusion is positioned in alignment with a slide mover, it holds the latter in its non-selected position; and the two selector bars of each selector bar pair have their protrusions longitudinally spaced in such a way in relation to the two slide movers of the accociated slide mover pair that, whenever both selector bars have the same longitudinal position, a protrusion on one selector bar holds one slide mover in its non-selected position and a protrusion on the other selector bar holds the other slide mover in the non-selected position.

3. A cam slide driving mechanism as defined in claim 2, wherein the distance between the two longitudinal selector bar positions is approximately equal to the spacing between the two slide movers of a slide mover pair;

one of the two selector bars of each selector bar pair has a protrusion so arranged that, in one selector bar position, it holds one slide mover in its non-selected position and, in the other selector bar position, it holds the other slide mover in its non-selected position; and the other one of the two selector bars has two protrusions which are spaced apart longitudinally by twice said slide mover spacing and at equal distances in front and behind said protrusion of the first selector bar.

4. A cam slide driving mechanism as defined in claim 1, wherein said slide movers are slide pushers which are attached to the rear ends of the cam slides and extend rearwardly therefrom;

said slide mover drive bar is a pushing drive bar;

said reversal point of the drive bar path between the return stroke and the drive stroke of the drive bar is located in the vicinity of the rear extremities of the slide pushers, so that the drive bar engages the slide pusher extremities of those slide pushers which are in the selected position, driving the latter in its drive stroke.

5. A cam slide driving mechanism as defined in claim 4, wherein the selector bar guiding means is part of a selector guide frame; and said guide frame is movable in a direction perpendicular to said slide pusher plane, away from and toward the latter, so that the selector bars can be moved longitudinally without touching any of the slide pushers, when the guide frame is in its distal position.

6. A cam slide driving mechanism as defined in claim 5, wherein the selector guide frame is pivotably supported on a pivot axis which is oriented parallel to the selector bars and which is located in the vicinity of the attached extremities of the slide pushers.

7. A cam slide driving mechanism as defined in claim 5, wherein the cam slide movements are horizontal movements;

the slide pushers extend generally horizontally rearwardly from the cam slides, being pivotable vertically between an upper non-selected position and a lower selected position;

the selector bars extend likewise horizontally and underneath the slide pushers, producing said selection interaction by raising and lowering the associated slide pushers;

the selector guide frame is movable vertically; and the pusher drive bar reciprocates along a generally horizontal path.

8. A cam slide driving mechanism as defined in claim 7, wherein the pusher drive bar has a profile which includes a forwardly extending supporting ledge and an upwardly extending profile portion forming a forwardly oriented driving face behind said supporting ledge; and the rear extremities of the slide pushers are so positioned in relation to the rear reversal point of the drive bar path that the driving face of the drive bar engages the slide pusher extremities of those slide pushers which are lowered to their selected position, while the non-selected slide pushers are raised above the level of the upwardly extending profile portion of the drive bar.

9. A cam slide driving mechanism as defined in claim 8, wherein the vertical movement of the selector guide frame is so coordinated with the reciprocating motion of the pusher drive bar that the downward motion of the selector bars starts as soon as the drive bar has moved underneath the raised non-selected slide pushers;

the selector bars, in the lowermost position of the selector guide frame, are freely movable longitudinally, without interfering with the lowered selected slide pushers, as the latter are being driven by the drive bar; and the selected slide pushers rest on the surrounding ledge of the drive bar, while moving therewith, while the non-selected slide pushers slide on the upwardly extending profile portion of the moving drive bar.

10. A cam slide driving mechanism as defined in claim 9, wherein the selector bars have a narrow rectangular profile which is oriented on edge;

the distance between the two longitudinal selector bar positions is approximately equal to the spacing between the two slide pushers of a slide pusher pair;

one of the two selector bars of each selector bar pair has a rectangular upwardly oriented selector tooth which is so arranged that, in one selector bar position, it holds one slide pusher in its non-selected position above the drive bar and, in the other selector bar position, it holds the other slide pusher in the same non-selected position; and the other one of the two selector bars has two such selector teeth which are spaced apart longitudinally by twice said slide pusher spacing and at equal distances in front and behind the selector tooth of the first selector bar.

11. A cam slide driving mechanism as defined in claim 5, wherein the punched tape feeler needles are oriented in general alignment with the selector bars and are guided for straight-line motion in said orientation; and the connection between each feeler needle and its associated selector bar includes an intermediate selector link and link connecting means for accommodating the perpendicular movements of the selector bar which result from the movement of the selector guide frame.

12. A cam slide driving mechanism as defined in claim 11, wherein the link connecting means associated with each intermediate selector link includes a first coupling sleeve between the feeler needle and the selector link and a second coupling sleeve between the selector link and the selector bar; and the coupling sleeves permit the connected parts to undergo a small angular deflection.

13. A cam slide driving mechanism as defined in claim 11, wherein said feeler needles and their connected selector bars are biased towards the punched tape by means of compression springs arranged on the opposite ends of the selector bars, between the latter and the selector guide frame.

14. A cam slide driving mechanism as defined in claim 1, wherein the punched tape includes auxiliary hole tracks alongside the hole tracks which control the drive selection of the cam slides; and the punched tape sensing means includes cooperating auxiliary feeder needles in alignment with said hole tracks, said auxiliary feeler needles being driven by the feeler needle drive bar.

* * * * *